US010378862B2

(12) United States Patent
Terai et al.

(10) Patent No.: US 10,378,862 B2
(45) Date of Patent: Aug. 13, 2019

(54) SECURITY AND DEBRIS BARRIER

(71) Applicant: HARBOR OFFSHORE, INC., Ventura, CA (US)

(72) Inventors: Jeffrey B. Terai, Ventura, CA (US); Clifford S. Center, Kingston, WA (US)

(73) Assignee: HARBOR OFFSHORE, INC., Ventura, CA (US)

( * ) Notice: Subject to any disclaimer, the term of this patent is extended or adjusted under 35 U.S.C. 154(b) by 0 days.

(21) Appl. No.: 16/009,874

(22) Filed: Jun. 15, 2018

(65) Prior Publication Data

US 2019/0137225 A1 May 9, 2019

Related U.S. Application Data

(63) Continuation-in-part of application No. 15/803,717, filed on Nov. 3, 2017.

(51) Int. Cl.

| | |
|---|---|
| ***F41H 11/05*** | (2006.01) |
| ***E02B 17/00*** | (2006.01) |
| *E02B 15/08* | (2006.01) |
| *B63G 9/04* | (2006.01) |

(52) U.S. Cl.

CPC ..... *F41H 11/05* (2013.01); *E02B 17/0017* (2013.01); *B63G 9/04* (2013.01); *E02B 15/085* (2013.01); *E02B 15/0807* (2013.01)

(58) Field of Classification Search

CPC combination set(s) only.
See application file for complete search history.

(56) References Cited

U.S. PATENT DOCUMENTS

| | | | |
|---|---|---|---|
| 1,151,607 | A | 8/1915 | Newhall, Jr. et al. |
| 1,772,888 | A | 8/1930 | Elia |
| 2,369,464 | A | 2/1945 | Kalnitz |

(Continued)

*Primary Examiner* — Kyle Armstrong
(74) *Attorney, Agent, or Firm* — Kristin C. Hiibner; Karish & Bjorgum, PC

(57) ABSTRACT

A barrier for protecting a port, waterway, or off-shore structure is provided. The barrier has a front elongated pontoon which extends substantially the length of the barrier. A net assembly, provided either in sections, or as an elongated net, extends vertically upward from the front elongated pontoon and along the length of the front elongated pontoon. The net assembly is affixed to the front elongated pontoon with one or more net support beams. The front elongated pontoon is supported by a rear pontoon support structure, which may be a series of pontoons, each connected to the front elongated pontoon and spaced apart the length of the front elongated pontoon, or an elongated cylindrically shaped rear pontoon which extends substantially the length of the barrier. In some embodiments, a rear net section is attached to the rear pontoon support structure. In another embodiment of the invention, a barrier system for protecting a port, waterway, or off-shore structure is provided. The barrier system comprises two or more contiguous barrier units, one of which is a barrier according to the present invention that form a perimeter to protect the port, waterway, or off-shore structure and can additionally act as a debris barrier. In one embodiment, the barrier system forms a perimeter protecting a port or waterway. In another embodiment, the barrier system protects an off-shore structure.

28 Claims, 11 Drawing Sheets

(56) References Cited

U.S. PATENT DOCUMENTS

| | | | | |
|---|---|---|---|---|
| 2,404,612 | A | 7/1946 | Bannerman | |
| 2,408,367 | A | 10/1946 | Brickman | |
| 2,408,482 | A | 10/1946 | Riddle | |
| 2,465,936 | A | 3/1949 | Schultz | |
| 3,454,244 | A | 7/1969 | Walander | |
| 3,537,587 | A | 11/1970 | Kain | |
| 3,810,595 | A | 5/1974 | Doolittle | |
| 3,827,660 | A | 8/1974 | Doolittle | |
| 3,845,633 | A | 11/1974 | Hammond | |
| 4,135,467 | A | 1/1979 | Loire et al. | |
| 4,398,848 | A | 8/1983 | Guilbeau | |
| 5,224,800 | A | 7/1993 | Mogridge et al. | |
| 5,524,875 | A | 6/1996 | Thommen, Jr. | |
| 6,533,495 | B1 | 3/2003 | Williams et al. | |
| 6,681,709 | B1 | 1/2004 | Nixon et al. | |
| 6,778,469 | B1 | 8/2004 | McDonald | |
| 6,843,197 | B1 | 1/2005 | Nixon et al. | |
| 6,905,283 | B1 | 6/2005 | Salyer, Sr. | |
| 7,044,076 | B2 | 5/2006 | Knezek et al. | |
| 7,063,484 | B2 | 6/2006 | Meeks et al. | |
| 7,140,599 | B1 | 11/2006 | Spink | |
| 7,140,802 | B2 | 11/2006 | Lamore | |
| 7,401,565 | B2 | 7/2008 | Nixon et al. | |
| 7,744,313 | B2 | 6/2010 | Terai et al. | |
| 2003/0136325 | A1* | 7/2003 | Wooley | B63G 9/04 114/240 R |
| 2006/0037526 | A1 | 2/2006 | Knezek et al. | |
| 2006/0239774 | A1 | 10/2006 | Williams et al. | |
| 2006/0286342 | A1 | 12/2006 | Elzey | |
| 2007/0133350 | A1 | 6/2007 | McDonald | |
| 2008/0105184 | A1 | 5/2008 | Nixon et al. | |
| 2009/0035068 | A1* | 2/2009 | Terai | B63G 9/04 405/211 |
| 2011/0227731 | A1* | 9/2011 | Iffergan | F41H 11/05 340/541 |
| 2014/0020900 | A1 | 7/2014 | Ford et al. | |
| 2015/0152615 | A1* | 6/2015 | Bishop | B63G 9/04 405/23 |
| 2018/0080744 | A1* | 3/2018 | Osienski | F41H 11/05 |

* cited by examiner

SECURITY AND DEBRIS BARRIER

CROSS-REFERENCE TO RELATED APPLICATIONS

This Application is a Continuation-in-Part of that claims the benefit and priority to U.S. patent application Ser. No. 15/803,717, filed Nov. 3, 2017, the contents of which are incorporated herein by reference in its entirety.

BACKGROUND

Ports, harbors and other waterfronts, waterways, and off-shore structures are vulnerable to attack by small watercraft, i.e., vehicles, vessels or crafts that move across or through water, such as a speedboat. These watercraft are common in the water and are used for many purposes such as for pleasure, recreation, physical exercise, commerce, transport of people, and goods. It is difficult to distinguish recreational watercraft from a hostile watercraft, such as, a watercraft loaded with explosives that is designed to detonate and cause harm to people, structures, and other watercraft. A small hostile watercraft can potentially slip into a harbor or other waterfront structure unnoticed or otherwise undeterred and cause severe damage to people and property.

Near shore, port, and off-shore barriers are known. Examples of such barriers are described in U.S. Pat. Nos. 4,135,467, 6,681,709, 6,843,197, and 7,401,565. These port security barriers (PSB or PSBs) are comprised of modular, floating barrier sections. Known PSB systems include a capture net and net support structure which operates to stop waterborne craft and prevent entry into a port. Prior art floating PSB systems are formed in barrier sections with a barrier net positioned atop spaced apart floating pontoons (see, FIG. 1, Prior Art). Longer floating PSB systems are multi-sectional, formed in approximately 50 foot sections, with individual barrier sections being linked together longitudinally with a connector assembly, which secures the individual barrier sections together. Over the span of a mile, there may be as many as 100 connecting barrier sections, and 100 corresponding connector assemblies. The cost of the connector assembly adds significant cost to the overall cost of the barrier system. As each connector assembly can cost between $3,000 to $5,000, this can add a cost of $300,000 or more per mile to the overall cost of the barrier. In addition, these multi-sectional floating PSB systems suffer the disadvantage of being subject to damage in the wind, waves, currents, storms and other harsh environmental conditions in unprotected areas or open ocean. When multi-sectional floating PSB systems are subject to environmental energies, such as storms, high wind or waves, the environmental energies can tip a barrier section of the multi-sectional floating PSB, twisting the elongated fence structure, making it vulnerable to threat. In addition, as the individual barrier sections of the prior art multi-sectional floating PSB systems are linked together with a connector assembly (approximately every 50 feet), there are additional replacement and maintenance costs for each connector assembly.

In addition, waterways, such as dams, rivers, inlets, channels and canals can become obstructed with debris, causing damage, time delay and associated cost to clear the debris obstruction. Floating debris can pass between the barrier sections (unless additional barriers to close the gap are installed), and/or under the barrier, interfering with gate systems, dams, and other valuable infrastructure.

Therefore, there is a need for an improved barrier system that is effective against high speed watercraft, and is resistant to environmental energies and subsequent damage to the barrier from barrier tipping, and corresponding increased maintenance costs. There is also a need for an improved barrier system that can block floating debris, and is easily modified to provide protection from subsurface debris.

SUMMARY

According to the invention, a barrier for protecting a port, waterway, or off-shore structure is provided. The barrier comprises a front elongated pontoon which extends substantially 100% the length of the barrier. A rear pontoon support structure is also provided. In one embodiment the rear pontoon support structure is a series of rear pontoon structures. In another embodiment, the rear pontoon support structure comprises an elongated rear pontoon. The dual pontoon barrier according to the present invention is highly stable and an effective barrier against threats, such as intruders, e.g., individuals attempting to scale the barrier, and small and high speed watercraft. In addition, the dual pontoon design, including the front elongated pontoon, is highly stable in open ocean environments and resistant to damage from environmental energies. As the front elongated pontoon of the barrier is substantially continuous (or provided in connected, substantially elongated longitudinal sections) over the length of the area to be protected, the front pontoon acts as a debris boom, providing protection from debris entering the protected area and interfering with gate systems, dams, and other valuable infrastructure. In addition, there are no connector assemblies (i.e., moving parts), along the length of the barrier, resulting in generally decreased installation and maintenance costs. A further advantage of the barrier according to the present invention is that the barrier is easily adaptable to include a debris screen or subsurface net to add further protection from sub-surface debris. This is particularly useful when the barrier is installed in shallow water to protect near or on shore structures.

According to one embodiment of the invention, the barrier comprises a front elongated pontoon. Net support beams are spaced apart perpendicularly the length of the front elongated pontoon and extend vertically upward from the front elongated pontoon. A net assembly, comprising an elongated net, or a series of nets, which extend substantially 100% the length of the barrier, is affixed to the net support beams. To aid in the stabilization of the barrier, one or more rear pontoon support structures are positioned opposite the front elongated pontoon, and are spaced apart the length of the barrier. Each rear pontoon support structure comprises a rear pontoon positioned parallel to the front elongated pontoon one or more truss beams affixed perpendicularly to the elongated front pontoon and the rear pontoon.

In one embodiment, the rear pontoon support structure comprises a plurality of rear pontoon support structures spaced apart the length of the front elongated pontoon. Each rear pontoon support structure comprises a rear pontoon positioned parallel to the front elongated pontoon, and one or more truss beams affixed perpendicularly to the elongated front pontoon, and the rear pontoon. Preferably, according to this embodiment, the net assembly extends the length of the front elongated pontoon.

According to another embodiment, the rear pontoon support structure comprises an elongated cylindrically rear pontoon, the rear pontoon extending the length of the barrier. According to this embodiment, a plurality of truss beams are affixed perpendicularly to the elongated front pontoon and the elongated rear pontoon. A plurality of rear net sections are also provided.

Additional support is provided to the barrier by the optional use of bracing structures. The bracing structures are affixed to a net support beam and one of the opposing pontoon support structures. In addition, one or more cross beams can be affixed to and between two of the one or more truss beams. In certain embodiments, the barrier may also have one or more of a gate structure, a barbed access barrier, and/or debris screen or net extending below the front elongated pontoon.

According to another embodiment of the invention, a barrier system for protecting a port, waterway, or off-shore structure is provided. The barrier system comprises two or more contiguous barrier units that form a perimeter to protect the port, waterway, and/or off-shore structure. One or more of the barrier units is a barrier having a front elongated pontoon that extends the length of the barrier, as described herein. Additional barrier units may comprise floating gate barriers, fixed security barriers, or other floating barrier systems, as known in the art.

FIGURES

These and other features, aspects and advantages of the present invention will become better understood from the following description, appended claims, and accompanying figures where:

DESCRIPTION

According to the present invention, a barrier for protecting a port, waterway, or off-shore structure is provided. The barrier has a front elongated pontoon which extends substantially the length of the barrier. A net assembly extends vertically upward from the front elongated pontoon and along the length of the front elongated pontoon. The front elongated pontoon is affixed to a horizontal steel truss system. The truss system joins to a rear pontoon support structure. According to one embodiment, the rear pontoon support structure is a series an opposing pontoons that act as an outrigger. According to another embodiment, the rear pontoon support structure is a rear pontoon that extends substantially the length of the barrier.

The barrier extends to substantially 100% of the water surface and has increased buoyancy/stability characteristics over known prior art systems, thereby requiring a higher lateral force to overturn the barrier. The barrier is designed to stop unwanted watercraft from entering into a port, waterway, or off-shore structure. To address the security requirements and threat of protestors, the system incorporates a net system comprising steel or nylon netting. The netting has been field tested to absorb energy and stop small vessels attempting to penetrate the barrier while under power. In addition, the front elongated pontoon of the barrier can act as a debris barrier. The vertical net structure of the barrier extends upwardly from the front elongated pontoon, and in some embodiments, additional underwater netting or other debris barrier that extends downward from the front elongated pontoon below the water for additional security and/or debris exclusion. The barrier according to the present invention prevents small watercraft carrying explosives or the like from damaging such valuable assets as oil pumping platforms, nuclear power plants, desalination plants, commercial ports, harbors and offshore drilling facilities, as well as dams, and other valuable infrastructure that are vulnerable to subsurface threats and damage from debris.

Figure 1:
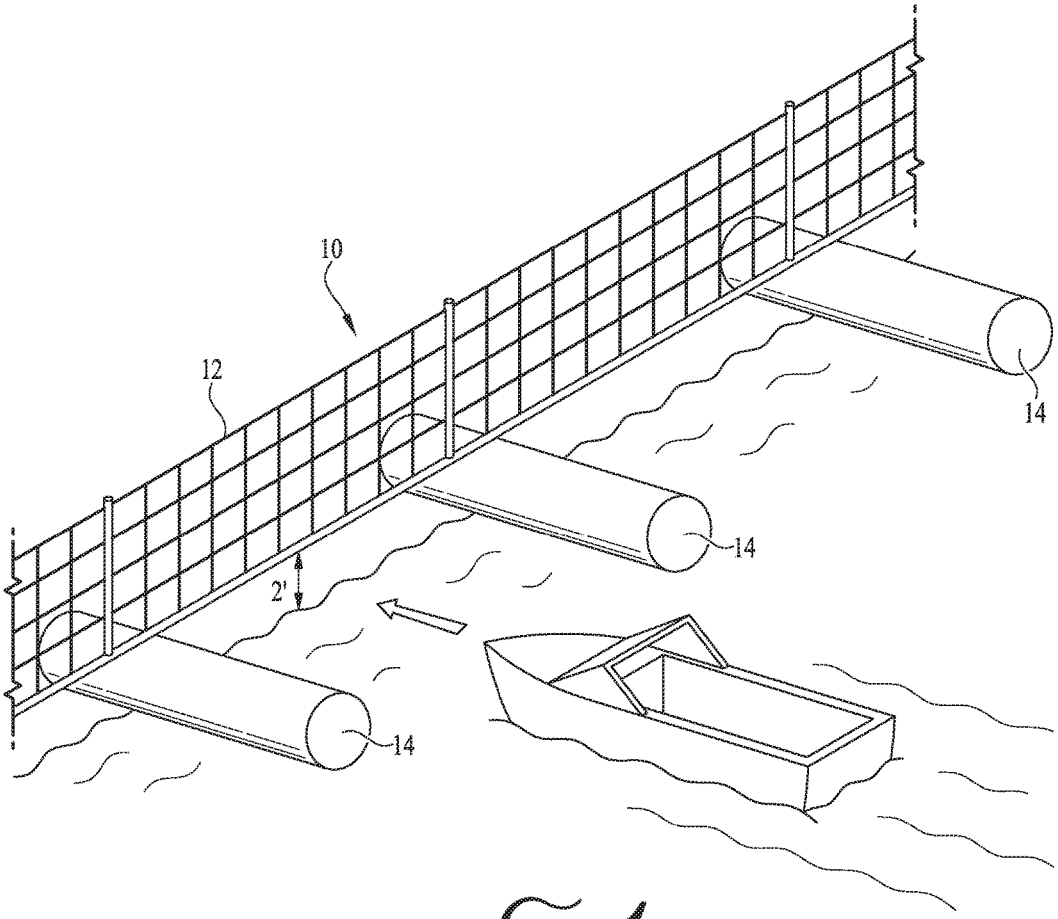
FIG. 1 PRIOR ART
FIG. 1 is an illustration of a prior art PSB system.

An exemplary prior art floating barrier system 10 is shown in FIG. 1. These prior art floating security barriers have a series of separated flotation pontoons 14 that support a net system 12. These multi-sectional floating security barriers are subject to environmental energies such as storms, high wind or waves which can tip a barrier section, making it vulnerable to threat. In addition, these prior art systems are subject to below water level threats such as swimmers, divers, and torpedoes, as they are accessible under the net and between the supporting pontoons. Without additional netting or other barrier structures, in some cases, the floating barrier systems can have 2 feet of open space between the net 12 and water, allowing floating debris to pass beneath and through the barrier, interfering with gate systems, dams, and other valuable infrastructure and are additionally vulnerable to subsurface threats. Further, waterways, such as dams, rivers, inlets, channels and canals can become obstructed with debris, causing damage, time delay and associated cost to clear the debris obstruction.

The barrier according to the present invention has a front elongated pontoon that extends the length of the barrier. A net, including net sections, is affixed atop the front elongated pontoon, eliminating gaps between the water line and net and also providing for debris exclusion. The barrier is easily adaptable to add additional netting to extend below the front elongated pontoon for additional sub-surface threat protection such as swimmers, divers, and torpedoes and subsurface debris exclusion. A primary advantage of the barrier of the present invention over known prior art systems, is that as the barrier is formed from a continuous elongated pontoon and netting system, the connector assemblies used in prior art floating multi-sectional barriers are eliminated. Another primary advantage of the dual pontoon barrier according to the invention is the stability of the barrier in open ocean. The barrier design, having a front elongated pontoon and rear supporting pontoons, is significantly resistant to environmental energies and highly stable in open ocean and rough weather conditions, resisting overturning in high wind, waves, currents, and storms, as compared to prior art multi-sectional floating barrier systems. In shallow water, the barrier also has the advantage of acting as a wave attenuator, as the elongated pontoon minimizes smaller surface waves of 2-3 feet or smaller. The barrier is also highly effective against intruders, small watercraft, and high speed watercraft, is easily adaptable to provide protection from subsurface threats, and can additionally block floating debris.

Figure 2A:
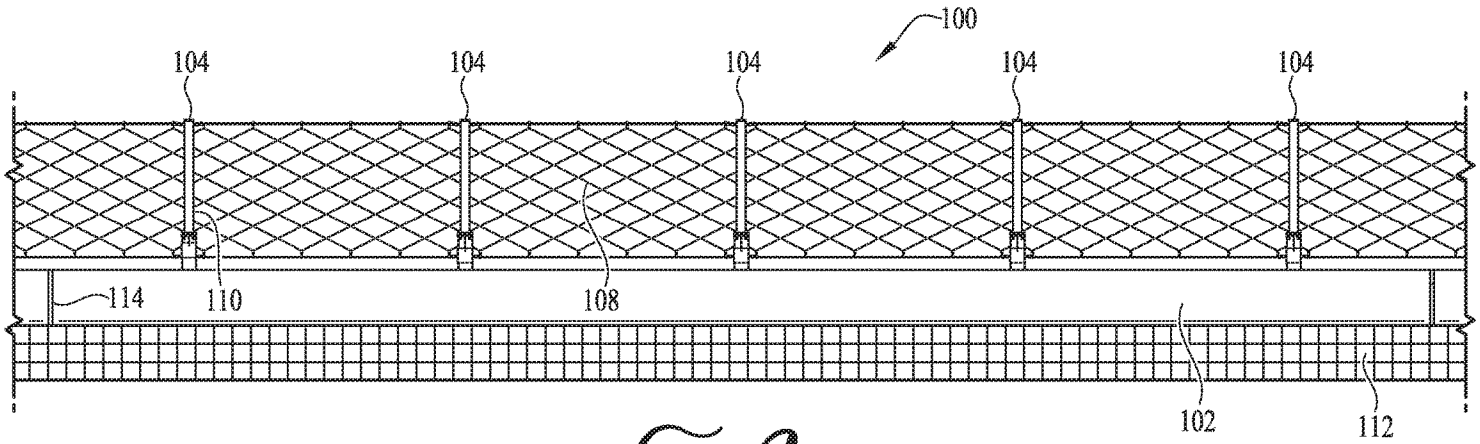
FIG. 2A is a front side illustration of a barrier according to one embodiment of the invention.
Figure 2B:
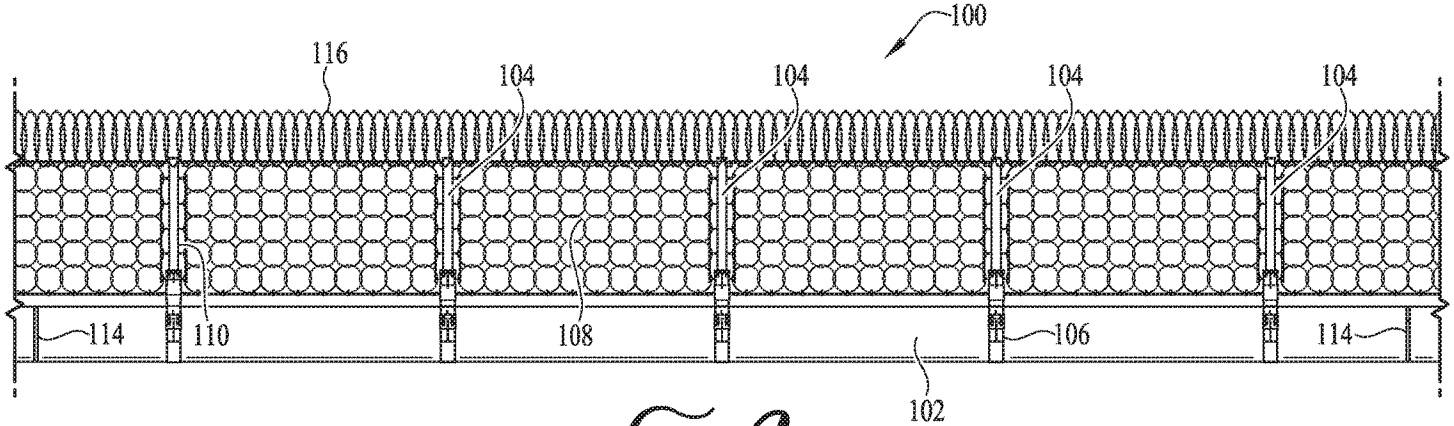
FIG. 2B is a front side illustration of a barrier according to another embodiment of the invention.
Figure 5:
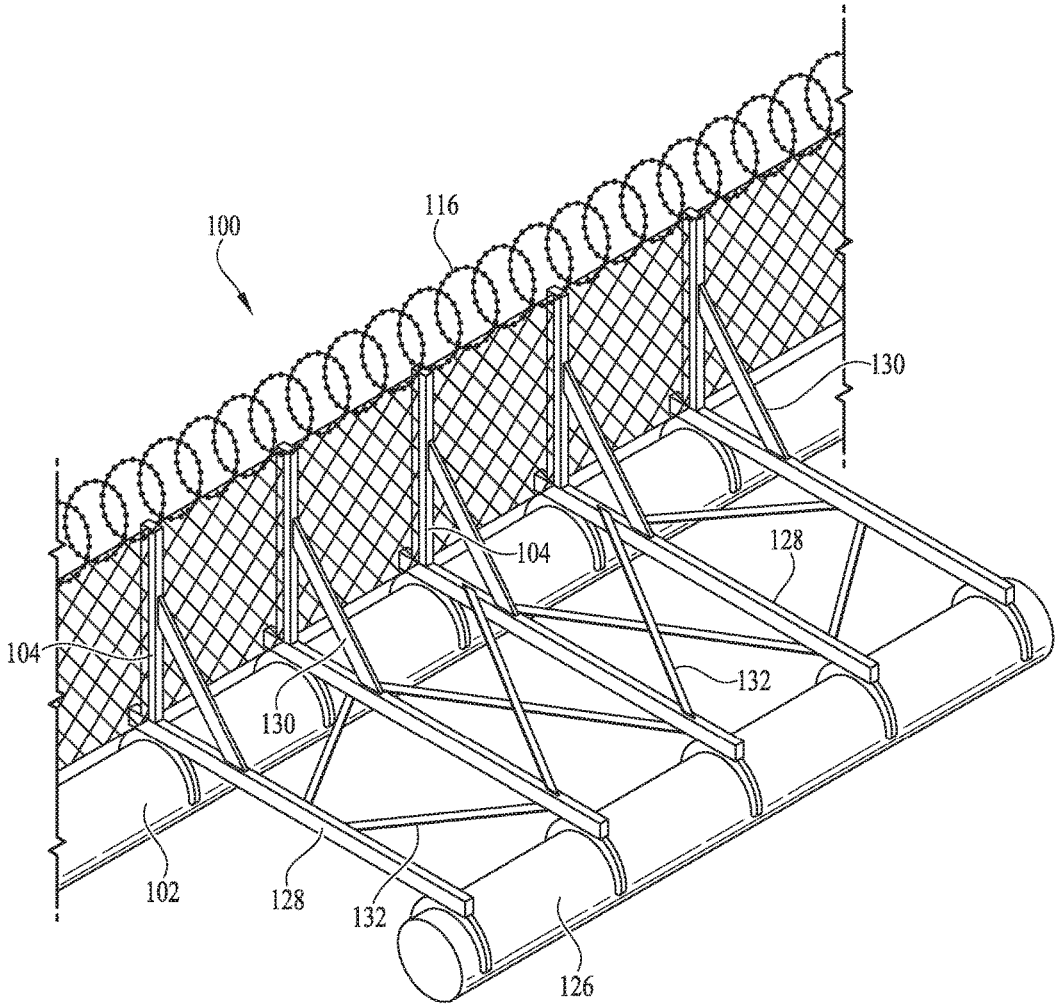
FIG. 5 is a back side perspective view of a barrier according to the embodiment of the invention shown in FIG. 2A.
Figure 6A:
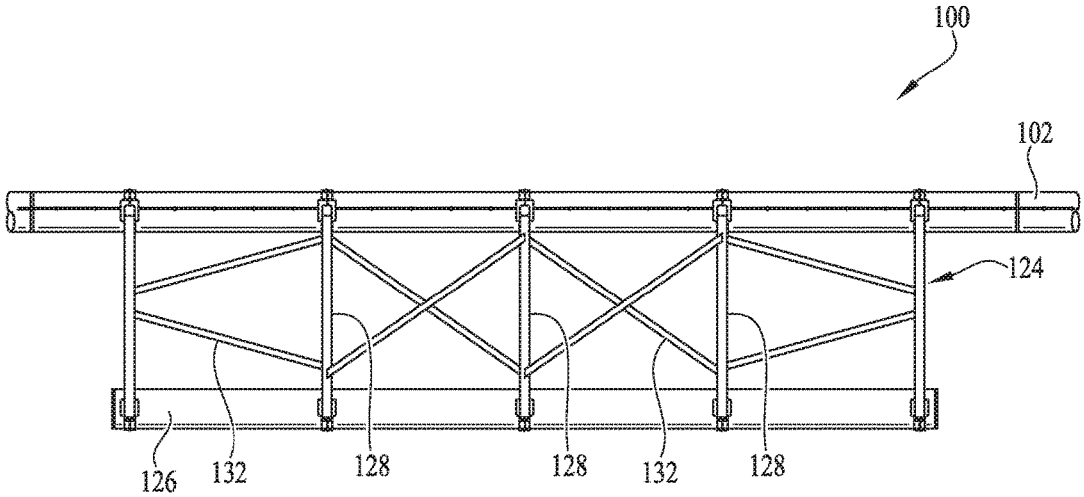
FIG. 6A is a top side (plan view) illustration of one embodiment of the rear pontoon and support structure, showing the front elongated pontoon, a rear pontoon, the truss supports, and the cross supports.
Figure 6B:
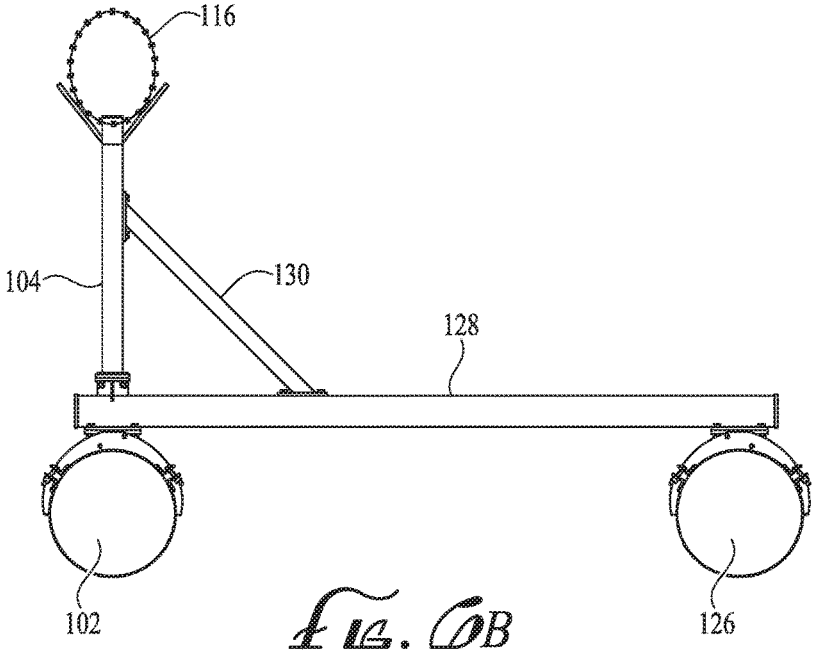
FIG. 6B is a side view of the barrier, showing the front elongated pontoon, truss support, and one embodiment of the side bracing structure.

Referring now to FIGS. 2A-2B; FIG. 5, and FIGS. 6A-6B, one embodiment of the barrier 100 according to the invention is shown. As shown in FIGS. 2A and 2B, a barrier 100, according to the present invention, for protecting a port, waterway, or off-shore structure is shown. The barrier 100 has a front elongated pontoon 102 comprising an elongated cylindrically-shaped pontoon, which extends the length of the barrier 100. In one embodiment, the barrier 100 protects a port, and the front elongated pontoon 102 extends substantially the length of the port. In another embodiment, the barrier 100 protects a dam or other waterway having land on two opposing sides of the dam or waterway, and the front elongated pontoon 102 extends substantially the width of a section of the dam or waterway extending between the land on the two opposing sides of the dam or waterway. In another embodiment, the barrier 100 further comprises a floating gate structure (see, FIG. 7, for example), which may be manually or mechanically actuated for access to a port, waterway, or off-shore structure.

As shown in FIGS. 2A and 2B, a plurality of net support beams 104 are positioned along the length of the front elongated pontoon, where each net support beam 104 is affixed perpendicularly to the front elongated pontoon 102 via a saddle assembly 106. The net support beam 104 extends vertically upward from the front elongated pontoon 102 to a desired height, such as 6 feet, but may have a height from 4 feet to 20 feet. As will be understood by those of skill in the art, the height of the net support beam 104 and net assembly 108, is highly variable, with a front pontoon 102 having a larger diameter being able to accommodate a higher net structure, but also increasing in cost. Various saddle assemblies 106 (also referred to as pontoon clamps) are known in the art for fastening the pontoon 102 to the net support beam 104. See, for example, US Pub. No. 2014/0209005.

Referring again to FIG. 2A and FIG. 2B, the front elongated pontoon 102 is preferably comprised of a continuous tube of a polymeric material, such as high density polyethylene (HDPE), or other suitable polymeric material. The length of the front elongated pontoon 102 and barrier 100 can extend a continuous length of 40 feet up to several miles or greater. The diameter of the front elongated pontoon 102 is preferably from about 24 inches to about 54 inches. In some embodiments, the front elongated pontoon 102 is comprised of a continuous unit. In other embodiments, the front elongated pontoon 102 is comprised of a plurality of units, for example, 40 to 50 foot sections, which are joined (spliced) together at a pontoon joint 114 to form the front elongated pontoon 102. In a preferred embodiment, the front elongated pontoon is foam filled to mitigate flooding in the event that the hull is compromised. An example of a preferred foam filling is expanded polystyrene insulation (EPS insulation). A suitable foam filling is commercially available from FMI-EPS, LLC, Post Falls, Id.

Referring now to FIG. 2A, in some embodiments, the barrier 100 may additionally have a debris screen 112 affixed to the front elongated pontoon 102. The debris screen 112 extends below the front elongated pontoon 102 into the water from between about 2 feet below the pontoon 102 or to a greater depth, in some cases, extending below the water surface by a distance defined or determined by environmental conditions and/or the level of underwater protection desired, and may extend to the floor of the water body, e.g., the sea floor. The debris screen 112 is comprised of netting, as described herein with reference to the net assembly 108, and as shown and described in reference to FIGS. 3A-3C and FIGS. 4A-4C, or the debris screen may be made of nylon or other polymeric netting, or steel or other metal alloy mesh or matting construction.

Referring now to FIGS. 2B, 5, 6B, 9A-9B, and 11, in some embodiments, the barrier 100 may optionally have a barbed access barrier 116, such as barbed tape or razor wire comprising metal strips with sharp edges whose purpose is to prevent passage by humans over the top of the barrier 100. For example, the barbed access barrier 120 is shown as spiral concertina wire in FIG. 2B, affixed to the top of the barrier 100 to protect against climbing over the system. However, other configurations of the barbed access barrier 116 are possible, as will be understood by those of skill in the art, and other embodiments do not have the optional barbed access barrier.

Referring again to FIG. 2A, FIG. 2B and FIG. 4, the net assembly 108 extends vertically upward from the front elongated pontoon 102. The net assembly 108 is affixed to one or more of the plurality of net support beams 104 and extends the length of the barrier 100 in the embodiment shown in FIGS. 2A-2B and FIG. 4. However, the net assembly may comprise other configurations, such as a plurality of net sections, as will be understood by those of skill in the art. In some embodiments, the net support beams 104 have net brackets 110 for affixing the net assembly 108 to the front elongated pontoon 102. However other configurations can be used to affix the net assembly 108 to the net support beams 104, as will be understood by those of skill in the art. The net assembly 108 extends from the top of the front elongated pontoon 102 to a height which is sufficient to prevent a waterborne craft from penetrating the barrier. For example, in a one embodiment, the net assembly is 6 feet high, but in other embodiments the net assembly 108 may have a height from 4 feet to 10 feet. The net assembly 108 can be formed from one or more net sections, each section joined to another net section, in series, at one or more of the net support beams 104. In other embodiments, the net assembly 108 is formed from a single continuous net. In other embodiments, the net assembly 108 comprises a system of ropes and energy absorbing devices. The structural components of the barrier are designed and configured in a manner as to absorb and displace the kinetic energy generated by an explosive laden small watercraft traveling at a high rate of speed. This embodiment of the net assembly 108 is further described in U.S. Pat. No. 7,744,313, incorporated herein by reference in its entirety.

Figure 3A:
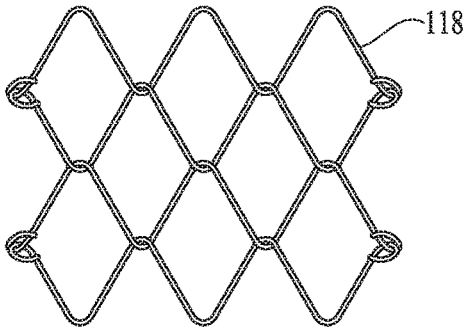
FIGS. 3A-3C and FIGS. 4A-4C, are front view illustrations of various embodiments of a net according to the invention.
Figure 3B:
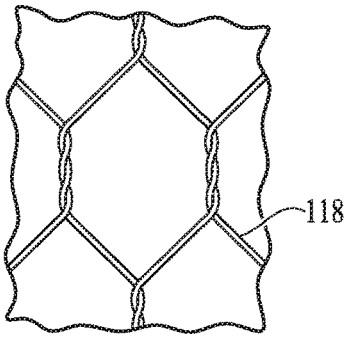
Figure 3C:
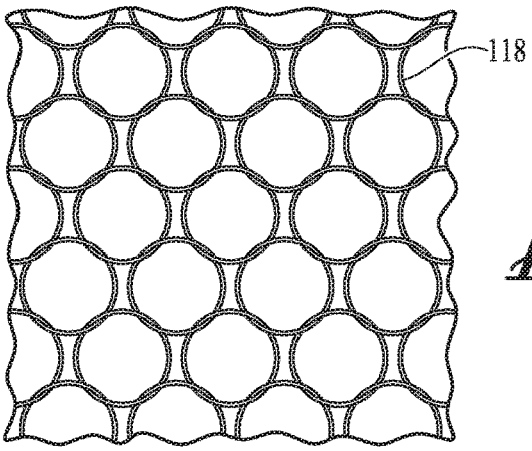
Figure 4A:
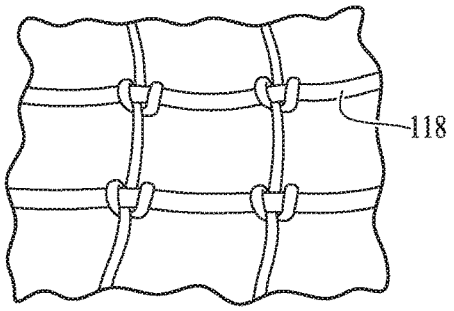
Figure 4B:
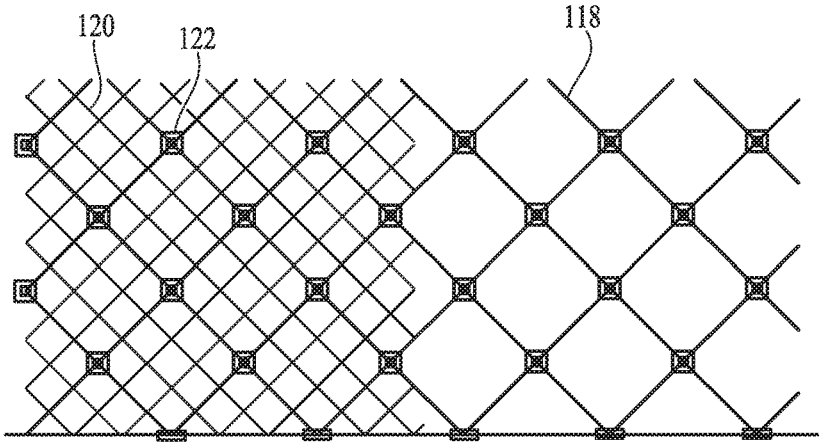
Figure 4C:
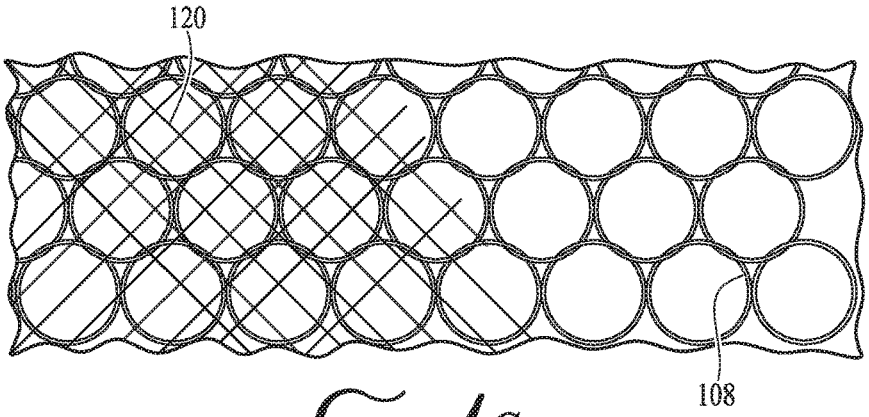

Referring now to FIGS. 3A-3C and FIGS. 4A-4C, the net assembly 108 comprises a net 118 comprised of nylon, steel, or other composite polymeric or metal alloy materials. Preferably, the net 118 is resistant to corrosions. As shown in FIG. 3A, the net 108 is a diamond-shaped mesh pattern. As shown in FIG. 3B, the net 118 is a diamond-shaped pattern having a double twist in the pattern. As shown in FIG. 3C, the net 118 is a rope net comprising a plurality of interconnecting rings. As shown in FIG. 4A, the net 118, is a rectangular mesh pattern. As shown in FIGS. 4B and 4C, the net 108 may have a mesh 120, which may be fastened to the net 108 with a clip 122. Examples of suitable nets include nylon nets commercially available from, Pacific Netting Products, Inc., Kingston, Wash., or metal netting commercially available from Rotec International, Maccaferri, and Geobrugg. The net 118 is preferably comprised of galvanized or stainless steel or other metal alloy having compliant elastic deformation, depending on the environmental conditions. Galvanized steel is typically used in fresh water and stainless steel is typically used in ocean or other salty water. This promotes the consistent and regular transmission of dissipated energy throughout the net system. However, the embodiments of the net 118 described herein and shown in FIGS. 3A-3C and FIGS. 4A-4C, are shown as examples, and other suitable nets may be used in the invention, as will be understood by those of skill in the art by reference to this disclosure.

Referring now to FIG. 5 and FIGS. 6A-6B, the barrier 100 has one or more rear pontoon support structures 124. According to one embodiment, the barrier 100 comprises a plurality of rear pontoon support structures 124 spaced apart the length of the front elongated pontoon 102, at a distance of approximately 8 feet to 10 feet apart, along the length of the front elongated pontoon 102. Each rear pontoon support structure 124 has a rear pontoon 126 positioned parallel to the front elongated pontoon 102. One or more truss beams 128 are affixed perpendicularly to the elongated front pontoon 102 and the rear pontoon 126. The one or more truss beams 128 are preferably a galvanized horizontal steel truss, but may be comprised of another material. The truss beam is preferably about 8 feet in length, but may be from 6 feet to 20 feet in length. The one or more truss beams 128 join the front elongated pontoon 102 and rear pontoon 126 in an opposing pontoon configuration that acts as an outrigger, stabilizing the barrier structure. The truss beams 128 have a preferred length of between 8 feet and 20 feet, which separate the front elongated pontoon 102 and the rear pontoon 126. One or more cross beams 132 are optionally affixed between the one or more truss beams 128. In one embodiment, the cross beams are configured in a cross or "x' configuration between two truss beams 128. However, other configurations are possible, as will be understood by those of skill in the art.

As shown in FIG. 6B, the barrier 100 and rear pontoon support structures 124 also have a plurality of bracing structures 130 to stabilize the opposing pontoon configuration. In one embodiment, the bracing structure 130 affixed to the net support beam 104 one end and a rear pontoon support structures 124 on the opposing end, forming a knee brace. However, other configurations for the bracing structures are possible, as will be understood by those of skill in the art.

The rear pontoon 126 is preferably comprised of HDPE or other suitable polymeric material, having a preferred length of 50 feet, but can vary depending on the specifications of the barrier 100, and can have a preferred length from 10 feet to 60 feet. The diameter of the rear pontoon 126 is preferably from about 24 inches to about 54 inches.

Figures 7A, 7B:
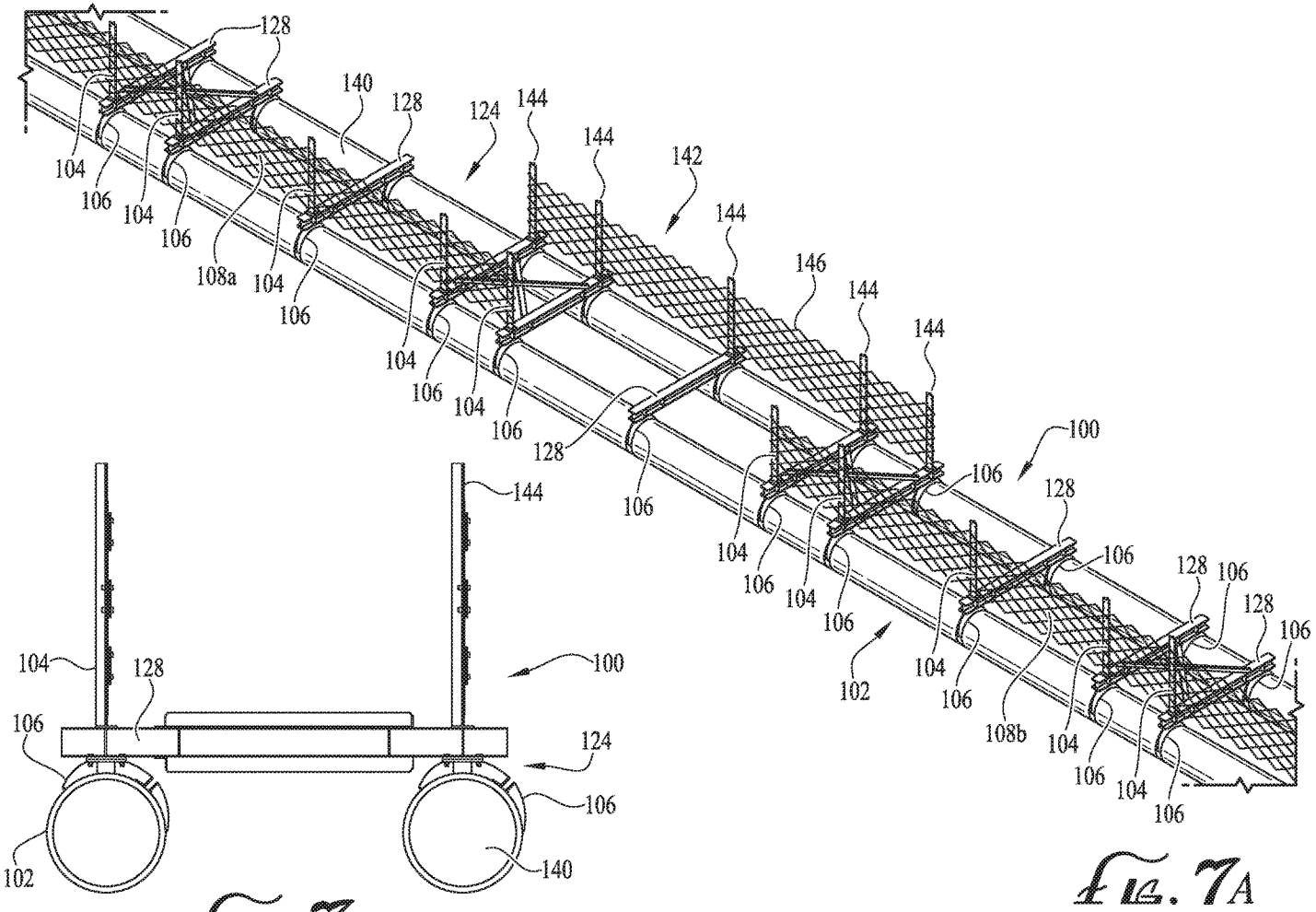
FIG. 7A is a front view perspective view of a barrier according to another embodiment of the invention.
FIG. 7B is a side view of the barrier according to the embodiment shown in FIG. 8A.

Referring now to FIGS. 7A-7B and FIGS. 8A-8B, another embodiment of the barrier 100 according to the invention is shown. As shown in FIGS. 7A and 7B, the barrier 100 has a front elongated pontoon 102 comprising an elongated cylindrically-shaped pontoon, which extends the length of the barrier 100. As described herein above, the barrier 100 protects a port, and the front elongated pontoon 102 extends substantially the length of the port. In another embodiment, the barrier 100 protects a dam or other waterway having land on two opposing sides of the dam or waterway, and the front elongated pontoon 102 extends substantially the width of a section of the dam or waterway extending between the land on the two opposing sides of the dam or waterway. In another embodiment, the barrier 100 further comprises a floating gate structure (see, FIG. 9, for example), which may be manually or mechanically actuated for access to a port, waterway, or off-shore structure.

Figure 8A:
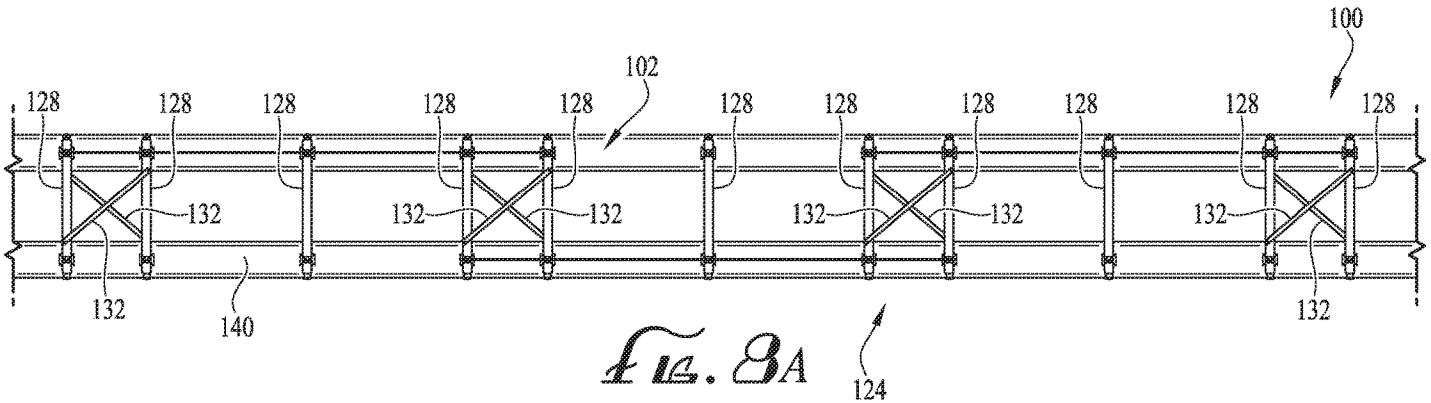
FIG. 8A is a top side (plan view) of the barrier according to the embodiment shown in FIG. 8A.
Figure 8B:
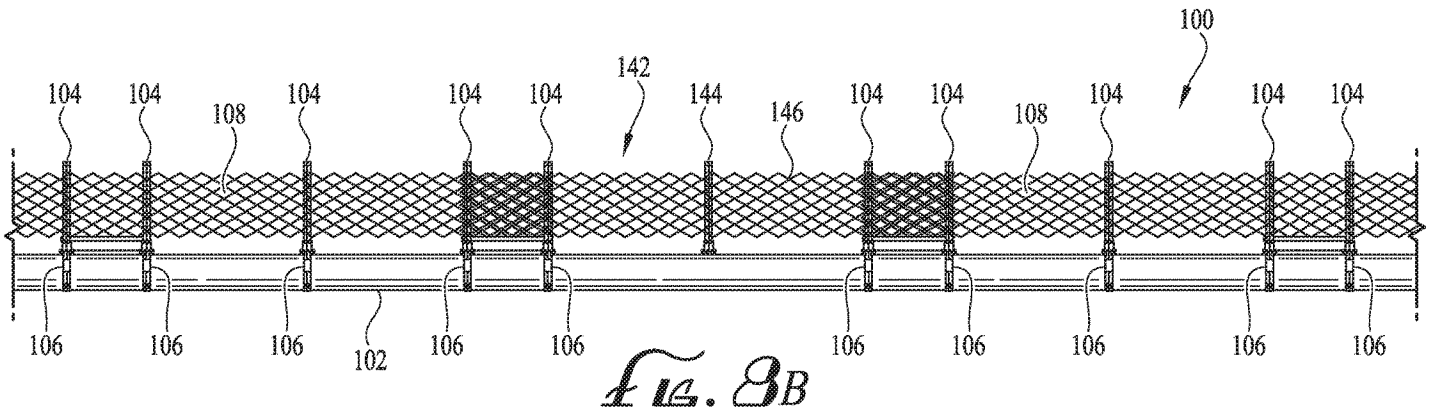
FIG. 8B is a front side view of the barrier according to the embodiment shown in FIG. 8A.

As shown in FIGS. 7A, 7B, and 8B a plurality of net support beams 104 are positioned along the length of the front elongated pontoon, where each net support beam 104 is affixed perpendicularly to the front elongated pontoon 102 via a saddle assembly 106. The net support beam 104 extends vertically upward from the front elongated pontoon 102 to a desired height, such as 6 feet, but may have a height from 4 feet to 20 feet. As will be understood by those of skill in the art, the height of the net support beam 104 and net assembly 108, is highly variable, with a front pontoon 102 having a larger diameter being able to accommodate a higher net structure, but also increasing in cost. Various saddle assemblies 106 (also referred to as pontoon clamps) are known in the art for fastening the pontoon 102 to the net support beam 104. See, for example, US Pub. No. 2014/0209005.

The front elongated pontoon 102 comprises the materials as described herein above, also having the dimensions and configurations as described herein above, including a debris screen 112, and/or optional barbed access barrier 116, as shown in reference to previously described Figures.

Referring again to FIG. 7A and FIG. 8B, according to the embodiment shown therein, the net assembly 108 comprises a plurality of front net sections 108*a*, 108*b*, where each net section extends vertically upward from the front elongated pontoon 102 and is affixed to one or more of the plurality of net support beams 104. The net assembly 108 extends the length of the barrier 100. In some embodiments, the net support beams 104 have net brackets 110 for affixing the net assembly 108 to the net support beam 104. However other configurations can be used to affix the net assembly 108 to the net support beams 104, as will be understood by those of skill in the art. The net assembly 108 extends from the top of the front elongated pontoon 102 to a height which is sufficient to prevent a waterborne craft from penetrating the barrier, as described herein above. FIGS. 3A-3C and FIGS. 4A-4C, show various embodiments of the net assembly 108 and net 118, as also previously described herein.

Referring now to FIGS. 7A-7B and FIG. 8A, the barrier 100 has a rear pontoon support structure 124 comprising an elongated rear pontoon 140, preferably cylindrically-shaped, the rear pontoon 140 extending the length of the barrier. A plurality of truss beams 128 are affixed perpendicularly to the elongated front pontoon 102 and the elongated rear pontoon 140. A plurality of rear net sections 142 is affixed to the elongated rear pontoon 140. Each rear net section 142 has a plurality of rear net support beams 144 spaced apart along a portion of the length of the rear pontoon 140, where each net support beam 144 is affixed perpendicularly to the rear pontoon 140 via a saddle assembly 106 and extends vertically upward therefrom. A rear net assembly 146 extends vertically upward from the rear pontoon 140 and is affixed to one or more of the plurality of rear net support beams 144. One or more cross beams 132 are optionally affixed between the one or more truss beams 128. In one embodiment, the cross beams are configured in a cross or "x' configuration between two truss beams 128. However, other configurations are possible, as will be understood by those of skill in the art.

A plurality of bracing structures may also be used to stabilize the opposing pontoon configuration, as described herein.

Figure 9A:
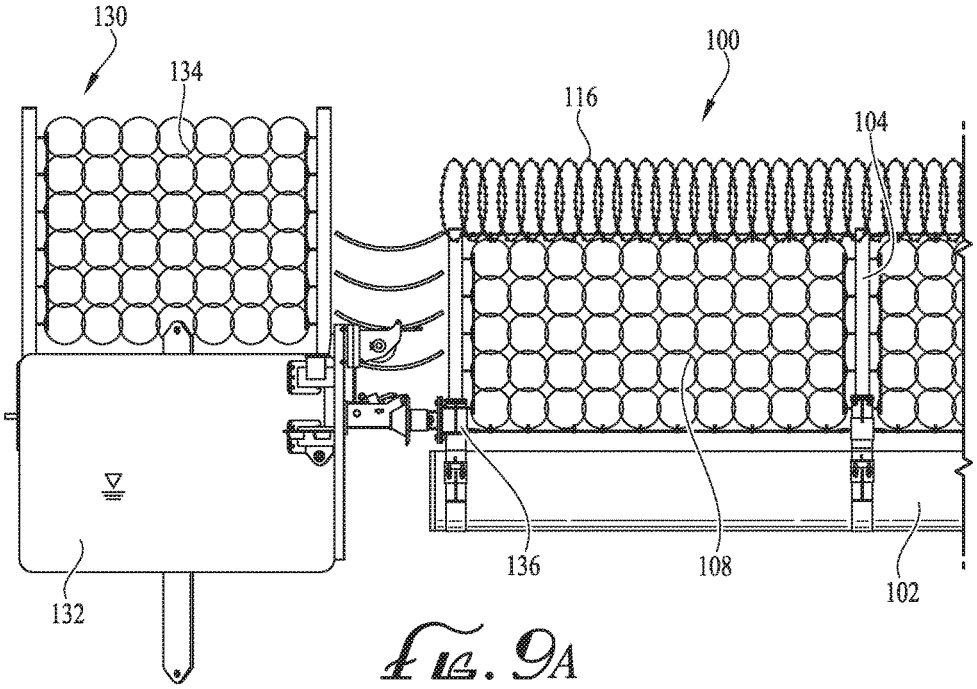
FIGS. 9A and 9B are a front side views of the barrier according to the invention, showing different configurations of barrier attachments to a buoy.
Figure 9B:
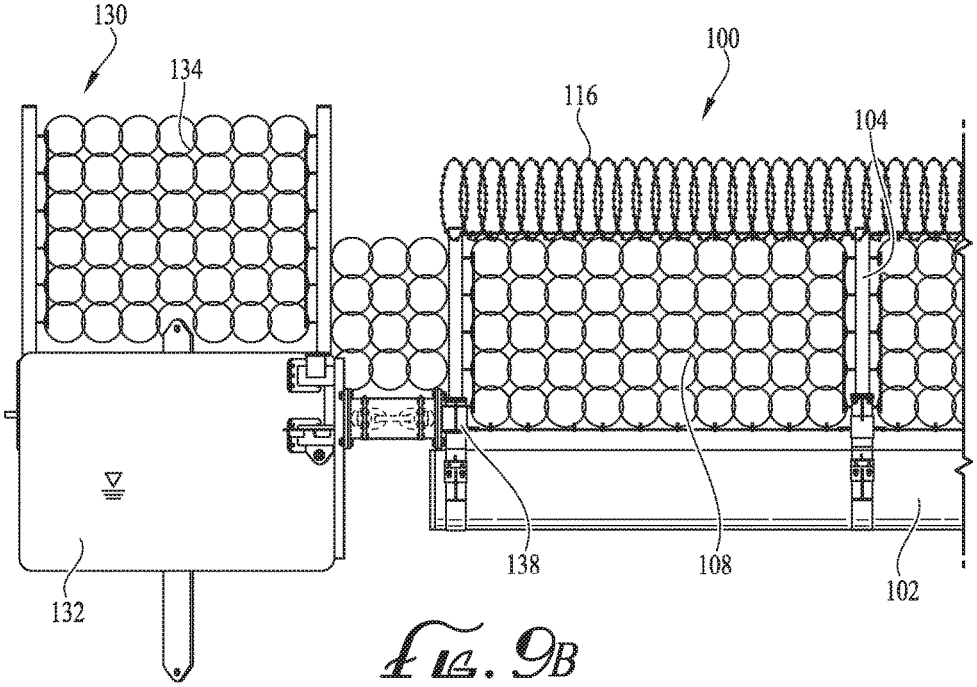

Referring now to FIG. 9A and FIG. 9B, a front side view of the barrier shown in FIG. 2B is shown, although the assembly described herein may be used with other barriers according to the invention, such as those shown in FIGS. 2A and 8A. FIGS. 9A and 9B show different configurations of barrier attachments to a mooring buoy assembly 130. As shown in FIGS. 9A and 9B, the barrier 100 is attached to a mooring buoy assembly 130 having a buoy and mooring 132 and an upper barrier structure 134 to prevent access. As shown in FIG. 9A, the barrier 100 is attached to the mooring buoy assembly 130 via a latch assembly 136. As shown in FIG. 9B, the barrier 100 is attached to the mooring buoy assembly via a buoy sleeve 138. As shown in FIG. 9B, additional fencing or netting 118*a*, such as steel or polymeric netting, as described herein, can be added between the barrier 100 and the mooring buoy assembly, for additional security. FIGS. 9A and 9B show two different types of latch assemblies 136, although other attachment means are possible, as will be understood by those of skill in the art. Further, the positioning of the latch assembly 136 can be either higher or lower on the mooring buoy 130, for emphasis on ease of access or security, as will also be understood by those of skill in the art.

In other embodiments, the barrier 100 is affixed to one or more end support structures comprising pilings driven into a floor of a water body, or the ground (for land adjacent barriers). This embodiment is further described in U.S. Pat. No. 7,744,313, incorporated herein by reference in its entirety. In one embodiment, the barrier end support structure comprises first and second end supports which are grounded in a stationary position, substantially perpendicular to a body of water, e.g., a sea floor. The barrier is affixed between the first and second end supports. In one embodiment, the first and second end supports are bottom, e.g., sea floor founded, and may be a steel piling, concrete piling, or spar arrangements of suitable size as to withstand applicable environmental energies. Accordingly, the supports are substantially stable such that they remain vertical and in a stationary position in adverse weather conditions and upon impact of the barrier with a vehicle. Preferably, the end supports are driven to a depth of about thirty-five feet below the floor of the body of water and rise about thirty feet above the water level. In another embodiment, one or both of the first and second end supports comprise a set of two pilings that are coupled together and include a set of coupling wires in an "X" formation. However, the end supports may be designed in a variety of configurations, such as one piling, which may have additional support tethers, or multiple pilings, coupled together by various methods as will be understood by those of skill in the art by reference to this disclosure.

Figure 10:
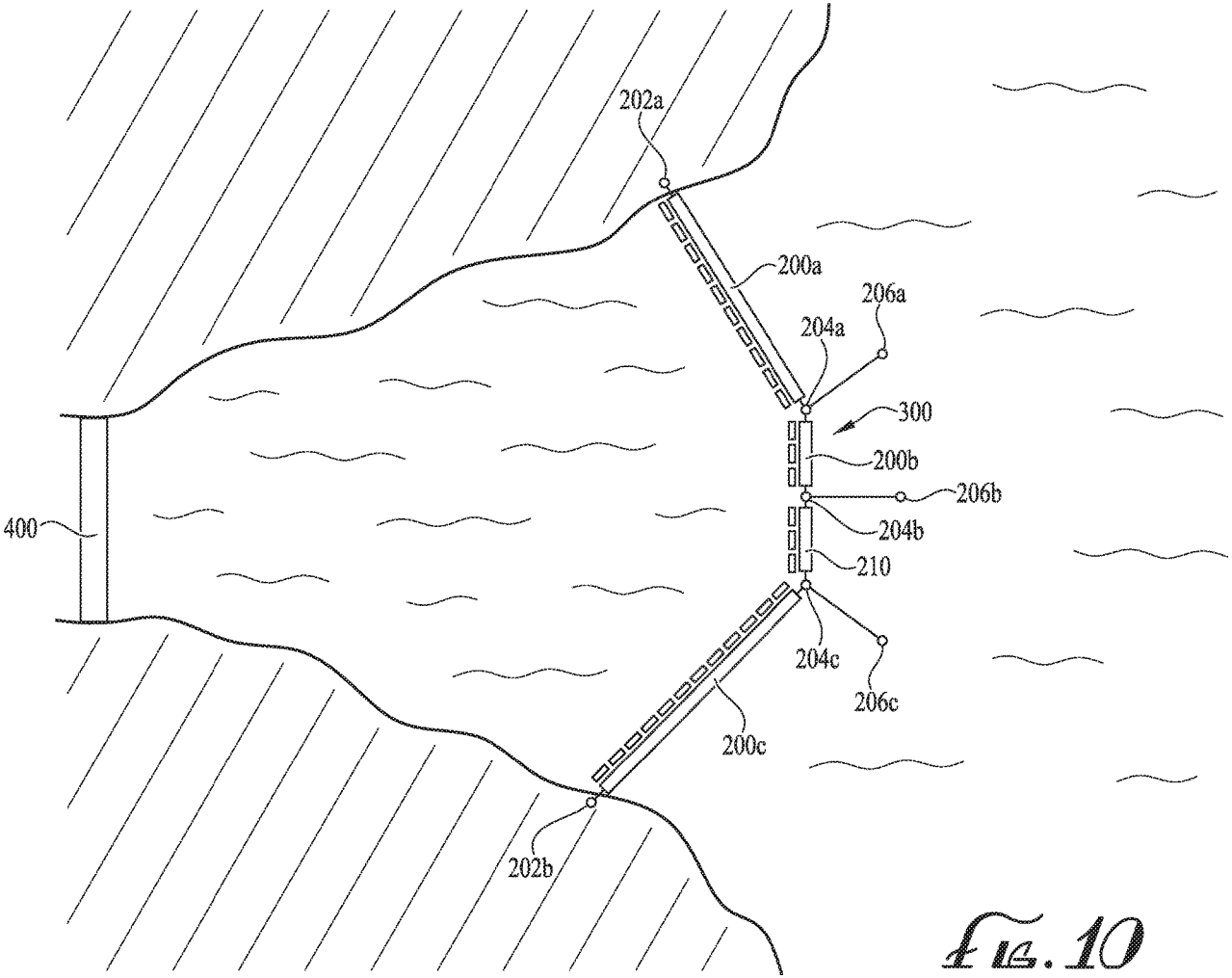
FIG. 10 is a top side (plan view) of a barrier system for protecting a waterway having land on two sides; according to another embodiment of the invention.
Figure 11:
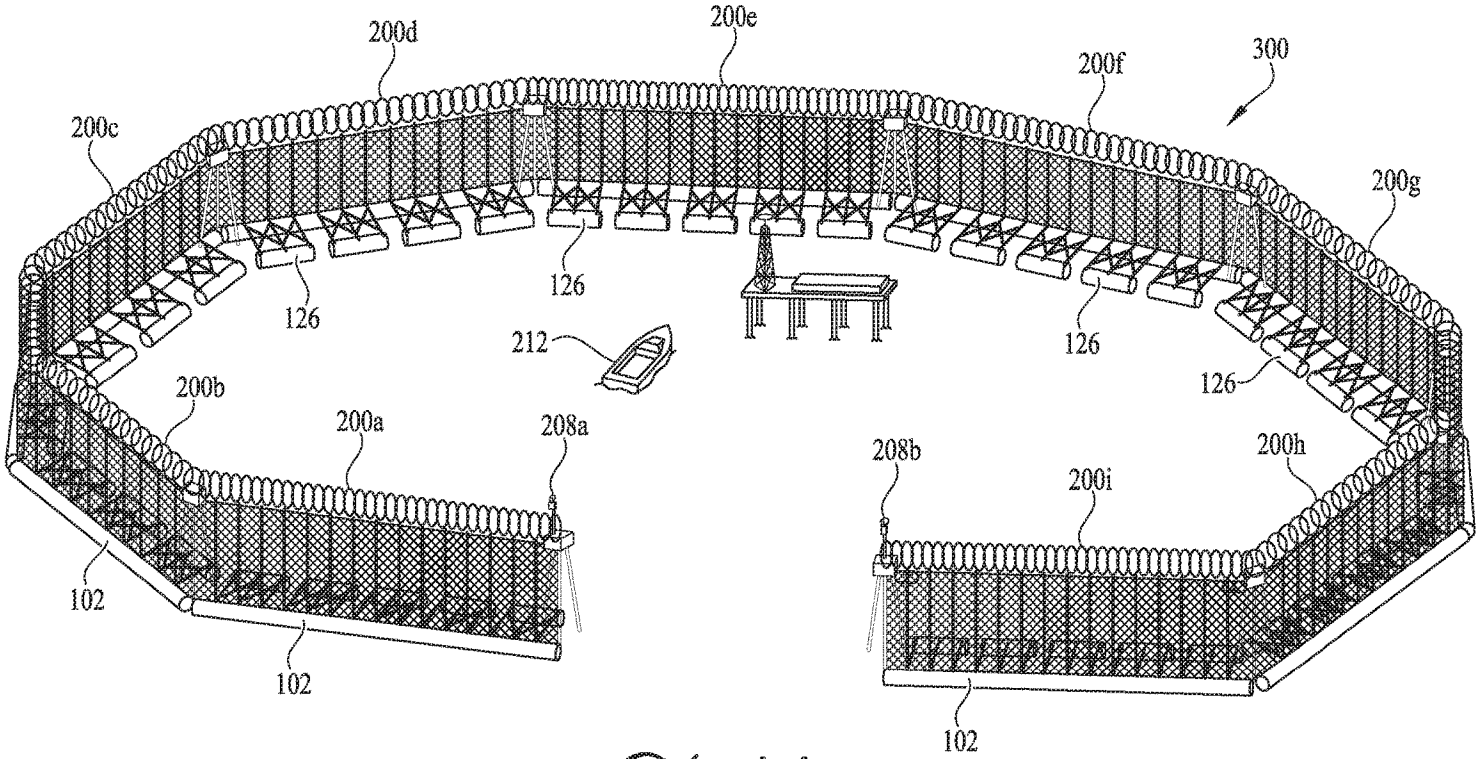
FIG. 11 is top side perspective illustration of a barrier system for protecting an off shore structure, according to another embodiment of the invention.

Referring now to FIG. 10 and FIG. 11, a barrier system 300 for protecting a port, waterway, or off-shore structure is provided, according to another embodiment of the invention. The barrier system comprises two or more contiguous barrier units that form a perimeter, wherein at least one barrier unit is a barrier according to the present invention. One of the barrier units may optionally be an access gate 210, the access gate 210 is a vertical action gate, preferably, the access gate 210 is remotely operated.

In one embodiment, the barrier system 300 protects a port or waterway. Referring now to FIG. 10, an exemplary barrier system 300 is shown having multiple contiguous barrier units 200*a*-200*c* which form a perimeter protecting a structure 400, such as a dam or harbor. The barrier units may be of varying configurations, as described herein. At least one of the barrier units 200 is a barrier 100 according to the present invention. As shown in FIG. 10, the barrier system comprises three contiguous barrier units 200*a*-200*c* and an optional barrier gate 210. The barrier unit 200*a* is moored on one end to a ground anchor 202*a* and at the opposing end to a mooring buoy 204*a*, which is anchored to an in-water anchor 206*a*. A second barrier unit 200*b* is moored on either end to mooring buoys 204*a* and 204*b*, which are in turn anchored to in-water anchors 206*a* and 206*b*, respectively. The optional gate 210 is attached to mooring buoys 204*b* and 204*c*. Another barrier unit 200*c* is anchored on one end to mooring buoy 204*c*, which is in turn anchored to in-water anchor 206*c*. The opposing end of barrier unit 200*c* is anchored to ground anchor 202*b*. FIG. 10 is an exemplary embodiment of the barrier system 300, where the contiguous barrier protects a structure 400 or other waterway having land on two opposing sides, and the contiguous barrier units extend substantially a width of a section of the waterway, extending between the land on the two opposing sides of the waterway. However, other configurations of barrier units, gating, and anchoring/mooring are possible as will be understood by those of skill in the art.

According to another embodiment, a barrier system 300 where the contiguous barrier units form a substantially circular perimeter around an off shore structure is provided. Referring now to FIG. 11, one embodiment of a barrier system 300 according to the invention is shown. The barrier system 300 comprises a plurality of contiguous barrier units 200*a*-200*i* that form a perimeter fence. At least one of the contiguous barrier units 200*a*-200*i* is a barrier unit 100 as described herein. In some embodiments, and at least one barrier unit 100 operates as an access gate (not shown). The barrier system 300 may also be equipped with electronic surveillance, such as cameras 208*a* and 208*b* at multiple points on the perimeter fence, and may also be equipped with electronic tracking for monitoring the approach of an aqueous vehicle 212.

Although the present invention has been discussed in considerable detail with reference to certain preferred embodiments, other embodiments are possible. Therefore, the scope of the appended claims should not be limited to the description of preferred embodiments contained herein.

What is claimed is:

1. A barrier for protecting a port, waterway, or off-shore structure, the barrier comprising:

(a) first and second end supports;

(b) a front elongated pontoon comprising an elongated cylindrically-shaped pontoon of unitary structure, the front elongated pontoon extending the length of the barrier between the first and second end supports and affixed thereto;

(c) a plurality of net support beams spaced apart the length of the front elongated pontoon, where each net support beam is affixed perpendicularly to the front elongated pontoon and extends vertically upward therefrom;

(d) a net assembly extending vertically upward from the front elongated pontoon and affixed to one or more of the plurality of net support beams; and (e) one or more rear pontoon support structures, each rear pontoon support structure comprising:

(i) a rear pontoon positioned parallel to the front elongated pontoon; and (ii) one or more truss beams affixed perpendicularly to the elongated front pontoon, and the rear pontoon; and (f) one or more cross beams, each cross beam affixed to and between two of the one or more truss beams.

2. The barrier according to claim 1 wherein:

the net assembly extends the length of the front elongated pontoon; and the rear pontoon support structure comprises a plurality of rear pontoon support structures spaced apart the length of the front elongated pontoon, each rear pontoon support structure comprising:

(i) a rear pontoon positioned parallel to the front elongated pontoon; and (ii) one or more truss beams affixed perpendicularly to the elongated front pontoon, and the rear pontoon.

3. The barrier according to claim 1 wherein:

the net assembly comprises a plurality of net sections, where each net section extends vertically upward from the front elongated pontoon and is affixed to one or more of the plurality of net support beams; and the rear pontoon support structure comprises:

(i) an elongated cylindrically-shaped rear pontoon of unitary structure, the rear pontoon extending the length of the barrier and the distance between the first and second end supports;

(ii) a plurality of truss beams affixed perpendicularly to the elongated front pontoon and the elongated cylindrically-shaped rear pontoon; and (iii) a plurality of rear net sections, each rear net section comprising (x) a plurality of rear net support beams spaced apart along a portion of the length of the rear pontoon, where each net support beam is affixed perpendicularly to the rear pontoon and extends vertically upward therefrom, and (y) a rear net assembly extending vertically upward from the front elongated pontoon and affixed to one or more of the plurality of net support beams.

4. The barrier according to claim 1 wherein the barrier further comprises a plurality of rear net sections, where each rear net section is affixed to the rear pontoon.

5. The barrier according to claim 1 wherein the barrier further comprises a plurality of bracing structures, each bracing structure, individually, affixed to the net support beam and one of the rear pontoon support structures.

6. The barrier according to claim 5 wherein at least one of the bracing structures is affixed to the net support beam and extends downward to affix to one of the truss beams.

7. The barrier according to claim 1 wherein the barrier further comprises a gate structure.

8. The barrier according to claim 1 wherein the barrier further comprises a barbed access barrier.

9. The barrier according to claim 1 wherein the barrier further comprises a debris screen or net, the debris screen or net extending at least partially the length of the barrier and extending below the front elongated pontoon.

10. The barrier according to claim 1 wherein the barrier protects a port or other waterway, and the front elongated pontoon extends substantially the length of the port or other waterway.

11. The barrier according to claim 1 wherein the barrier protects a dam or other waterway having land on two opposing sides of the dam or waterway, and the front elongated pontoon extends substantially the width of a section of the dam or waterway, extending between the land on the two opposing sides of the dam or waterway.

12. The barrier according to claim 1 wherein the plurality of rear pontoon support structures are spaced apart the length of the front elongated pontoon, at a distance of approximately 10 feet, center to center.

13. The barrier according to claim 1 wherein at least two of the plurality of cross beams are affixed to and between two truss beams.

14. The barrier according to claim 13 wherein the at least two cross beams are affixed to and between the two truss beam in a crossed pattern.

15. The barrier according to claim 1 wherein the net is comprised of one or more materials selected from the group consisting of: nylon, steel and another alloy.

16. The barrier according to claim 1 wherein the net has a pattern selected from the group consisting of: a net having a diamond-shaped mesh pattern, a net having a rectangular mesh pattern, and a net having a plurality of interconnecting rings.

17. The barrier according to claim 1 wherein the net extends from the top of the front elongated pontoon to a height which is sufficient to prevent a waterborne craft from penetrating the barrier.

18. The barrier according to claim 1 wherein the net comprises one or more net sections, each section joined to another net section, in series, at one or more of the net support beams.

19. The barrier system for protecting a port, waterway, or off-shore structure, the barrier system comprising:

two or more contiguous barrier units that form a perimeter, wherein at least one barrier unit is a barrier according to claim 1.

20. The barrier system according to claim 19 wherein one or more of the barrier units further comprises a debris screen or net, the debris screen or net extending at least partially the length of the barrier unit and extending below the front elongated pontoon.

21. The barrier system according to claim 19, wherein the contiguous barrier units form a perimeter protecting a port or waterway.

22. The barrier system according to claim 21, wherein the contiguous barrier protects a waterway having land on two opposing sides of waterway, and the contiguous barrier units extend substantially a width of a section of the waterway.

23. The barrier system according to claim 19 wherein the contiguous barrier units form a substantially circular perimeter around an off shore structure.

24. The barrier system according to claim 19, wherein at least one barrier unit operates as a floating barrier gate.

25. The barrier according to claim 1, wherein each end support, individually, comprises a mooring buoy assembly or an end support structure.

26. The barrier according to claim 1, wherein the unitary structure of the front elongated pontoon comprises a continuous unit or a plurality of units spliced together to form the unitary structure.

27. A barrier for protecting a port, waterway, or off-shore structure, the barrier comprising:

(a) first and second end supports;

(b) a front elongated pontoon comprising an elongated cylindrically-shaped pontoon of unitary structure, the front elongated pontoon extending the length of the barrier and between the first and second end supports and affixed thereto;

(c) a plurality of net support beams spaced apart the length of the front elongated pontoon, where each net support beam is affixed perpendicularly to the front elongated pontoon and extends vertically upward therefrom;

(d) a net assembly extending vertically upward from the front elongated pontoon and extending the length of the front elongated pontoon, the net assembly being affixed to one or more of the plurality of net support beams;

(e) a plurality of rear pontoon support structures spaced apart the length of the front elongated pontoon, each rear pontoon support structure comprising:

(i) a rear pontoon positioned parallel to the front elongated pontoon; and (ii) one or more truss beams affixed perpendicularly to the elongated front pontoon, and the rear pontoon; and (f) one or more cross beams, each cross beam affixed to and between two of the one or more truss beams.

28. A barrier for protecting a port, waterway, or off-shore structure, the barrier comprising:

(a) first and second end supports;

(b) a front elongated pontoon comprising an elongated cylindrically-shaped pontoon of unitary structure, the front elongated pontoon extending the length of the barrier and between the first and second end supports and affixed thereto;

(c) a plurality of net support beams spaced apart the length of the front elongated pontoon, where each net support beam is affixed perpendicularly to the front elongated pontoon and extends vertically upward therefrom;

(d) a net assembly comprising a plurality of front net sections, where each net section extends vertically upward from the front elongated pontoon and is affixed to one or more of the plurality of net support beams;

(e) a rear pontoon support structure comprising:

(i) an elongated cylindrically-shaped rear pontoon, the rear pontoon extending the length of the barrier;

(ii) a plurality of truss beams affixed perpendicularly to the elongated front pontoon and the elongated cylindrically-shaped rear pontoon; and (iii) a plurality of rear net sections, each rear net section comprising (x) a plurality of rear net support beams spaced apart along a portion of the length of the rear pontoon, where each net support beam is affixed perpendicularly to the rear pontoon and extends vertically upward therefrom, and (y) a rear net assembly extending vertically upward from the front elongated pontoon and affixed to one or more of the plurality of net support beams; and (f) one or more cross beams, each cross beam affixed to and between two of the plurality of truss beams.

* * * * *